US006283494B1

(12) United States Patent
Bourdeau

(10) Patent No.: US 6,283,494 B1
(45) **Date of Patent: *Sep. 4, 2001**

(54) SPORTS BOOT FOR SNOWBOARDING AND AN ASSEMBLY OF SUCH BOOT WITH A SNOWBOARD BINDING

(75) Inventor: Joel Bourdeau, Saint-Jorioz (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/305,754

(22) Filed: May 6, 1999

Related U.S. Application Data

(63) Continuation of application No. 08/869,481, filed on Jun. 5, 1997, now Pat. No. 5,941,554.

(30) Foreign Application Priority Data

Jun. 6, 1996 (FR) ..... 96 07261

(51) Int. Cl.[7] ..... A63C 9/00; A43B 5/04

(52) U.S. Cl. ..... 280/617; 280/14.21; 36/117.1; 36/109; 36/107

(58) Field of Search ..... 36/117.1, 115, 36/109, 107, 117.4, 118.3, 118.4, 119.1; 280/14.21, 617, 618, 629, 633

(56) References Cited

U.S. PATENT DOCUMENTS

| | | | |
|---|---|---|---|
| 3,854,743 | 12/1974 | Hansen | 36/2.5 |
| 4,979,760 | 12/1990 | Derrah | 36/120 |
| 5,056,509 | 10/1991 | Swearington | 36/89 |
| 5,226,875 | 7/1993 | Johnson | 36/89 |
| 5,356,170 | 10/1994 | Carpenter et al. | 280/618 |
| 5,379,530 | 1/1995 | Bell et al. | 36/89 |
| 5,406,721 | 4/1995 | Marcolin | 36/105 |
| 5,435,080 | 7/1995 | Meiselman | 36/117 |
| 5,505,477 | 4/1996 | Turner et al. | 36/120 |
| 5,606,808 | 3/1997 | Gilliard et al. | 36/89 |
| 5,701,689 | 12/1997 | Hansen et al. | 36/115 |
| 5,732,483 | 3/1998 | Cagliari | 36/115 |
| 5,941,554 * | 8/1999 | Bourdeau . | |

FOREIGN PATENT DOCUMENTS

| | | |
|---|---|---|
| 0646334 | 4/1995 | (EP) . |
| WO96/36407 | 11/1996 | (WO) . |

* cited by examiner

*Primary Examiner*—Ted Kavanaugh
(74) *Attorney, Agent, or Firm*—Greenblum & Bernstein, P.L.C.

(57) ABSTRACT

A sports boot adapted to be associated to a glide board for snowboarding, via a detachable binding device that includes a rear support spoiler that is relatively rigid. The boot includes an external sole overhung with a shell base that extends towards the lower part of the user's leg via a relatively flexible upper that is capable of cooperating with the rear support spoiler which is relatively rigid, and affixed to the board, during a rear edge setting, wherein the upper includes an arrangement for distributing the pressure exerted on the lower part of the user's leg when the upper takes support on the spoiler, such arrangement including a relatively rigid plate attached to a more flexible rear zone of upper and insulated from all the rigid parts of the boot in order to maintain the flexibility of the upper.

29 Claims, 1 Drawing Sheet

SPORTS BOOT FOR SNOWBOARDING AND AN ASSEMBLY OF SUCH BOOT WITH A SNOWBOARD BINDING

CROSS-REFERENCE TO RELATED APPLICATIONS

This application is a continuation of application Ser. No. 08/869,481, filed on Jun. 5, 1997, now U.S. Pat. No. 5,941,554, issued on Aug. 24, 1999, the disclosure of which is hereby incorporated by reference thereto in its entirety and the priority of which is claimed under 35 USC 120.

This application is also based upon French application No. 96.07261, filed on Jun. 6, 1996, the disclosure of which is hereby incorporated by reference thereto in its entirety and priority of which is hereby claimed under 35 USC 119.

BACKGROUND OF THE INVENTION

1. Field of the Invention

The present invention is related to a sports boot that is adapted to be associated with a glide board for snowboarding, the boot including an upper that is affixed to sole adapted to cooperate with the board. The invention also includes the combination of such boot and a binding for retaining the boot on a glide board.

2. Description of Background and Relevant Information

Several types of boots exist for practicing the above-mentioned sport. Rigid boots are known to be attached to the board via a system of rear and front stirrups, such system having a latching control located on one of the stirrups and being activated either manually or automatically.

Flexible boots are also known, that are inserted into a shell affixed to the board, the shell including a certain number of straps adapted to affix the boot to the shell.

The main disadvantage of rigid boots lies in the fact that they do not allow for a certain slack or flexibility required for snowboarding. In addition, comfort becomes an arbitrary factor, due to their design and the rigid materials used. Also, the walking function of such boots is not efficient, although it is a function that is particularly necessary and useful for a snowboarder. In the second case, although flexible boots are extremely comfortable while walking, the complementary arrangement of flexible boots with rigid shells is unsatisfactory because of the cumbersome volume of the shells on the board, and also a certain amount of discomfort that is directly linked to the bad retention of the foot and the presence of localized contact between the flexible upper and the rigid parts of the shell.

One solution set forth in U.S. Pat. No. 5,356,170 is intended to find a compromise that enables the use of a flexible boot with a less cumbersome shell that is attached to the board.

More specifically, the proposed device provides a relatively rigid rear support member, such as a spoiler, at the rear of the binding device of the boot, the support member being affixed to the board via fastening means, thus enabling the user to take support on it during a rear edge setting.

This provides definite advantages in the practice of this sport, but some disadvantages have become apparent over time.

Indeed, difficulty arises in finding the correct compromise in the radius of curvature in a horizontal sectional plane of the rear support spoiler. More specifically, if this radius is too encompassing with respect to the upper of the boot, then the spoiler can no longer provide adequate lateral flexibility in some snowboarding positions.

If, on the contrary, the corresponding section of the spoiler in question is given a relatively flat shape so as to avoid this disadvantage, then in that case the flexible upper of the boot that takes support against this flat surface will exert very substantial pressure on a small contact surface that corresponds overall to a generatrix of the upper of the boot with a much smaller radius, leading to substantial pressure on the lower portion of the leg, and will become synonymous with discomfort and pain.

It can also be thought that boots, such as cross-country ski boots with journaled rigid collars, could overcome the disadvantages cited hereinabove by eliminating the above-cited rear support spoiler. In fact, such would not be the case at all, because regardless of whether such boots are associated or not to a rigid rear spoiler, the fact remains that the stiffness of the collars of such boots too greatly limits the lateral flexibility that is required for snowboarding. In addition, these boots are a lot less adapted for walking because of the presence of the collar that stiffens the upper of the boot.

It has not been possible to find a compromise solution in order to resolve the problems that have been cited hereinabove.

SUMMARY OF THE INVENTION

The present invention achieves a solution by proposing a sports boot that is adapted to be associated with a glide board for snowboarding, via a binding device that includes a relatively stiff rear spoiler, the boot including a relatively flexible upper capable of cooperating with the rear support spoiler, wherein the upper includes an arrangement for distributing the pressure exerted on the lower portion of the leg of the user when the upper takes support on the spoiler, such arrangement being constituted by a relatively rigid plate, attached to a more flexible rear zone of the upper, and isolated from all the rigid parts of the boot, so as to retain the flexibility of the upper.

It is well known that with such a boot, in which the upper has been left with the maximum of flexible zones, the boot retains the freedom to move in all directions, thus enabling complete lateral flexibility while practicing snowboarding, and complete flexibility while walking.

However, all these advantages do not preclude the use of the pressure distribution plate, since the concentration of this pressure at the rear of the boot generally causes pain and discomfort in the calf region of the user.

The present invention is also related to the characteristics that will become apparent from the description that follows, and which should be considered singly or in all their possible technical combinations.

BRIEF DESCRIPTION OF THE DRAWINGS

The following description, provided as a non-limiting example, will enable a better understanding of how the invention can be obtained, with reference to the annexed drawings wherein.

DETAILED DESCRIPTION OF THE INVENTION

Figure 1:
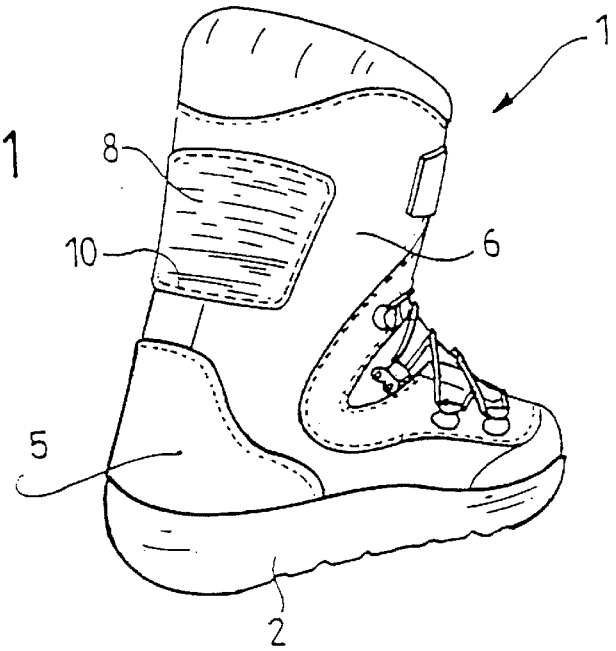
FIG. 1 is a rear perspective view of a boot according to the invention.

The boot 1 represented in the drawings is constituted by an external sole 2 adapted to be affixed on a glide board 3 by means of a binding device constituted of a rigid, intermediate cradle located between the sole 2 of the boot 1 and the board 3.

The external sole 2 of boot 1 is overhung with a rear heel stiffener 5 that can be rigid or semi-rigid, extending towards the bottom part of the leg of a user via an upper 6 that is relatively flexible, and capable of cooperating with a rear support spoiler 7 that is relatively rigid, and affixed to the board 3 by means of a binding device 4 forming a cradle. The role of the stiffener 5, which is known, is essentially that of a wear and tear resistance element. It can be made of leather, rubber, or plastic.

Figure 2:
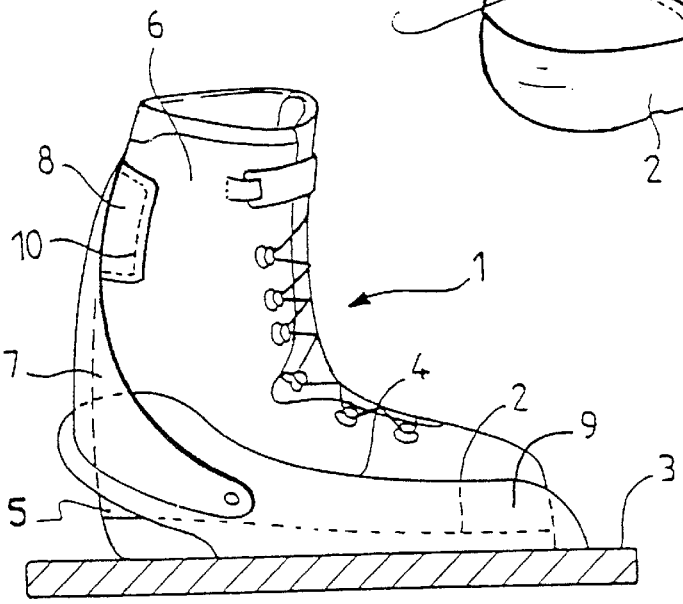
FIG. 2 is a view of the boot of FIG. 1, the boot being mounted on a glide board by means of a removable binding that includes a rear support spoiler.
Figure 3:
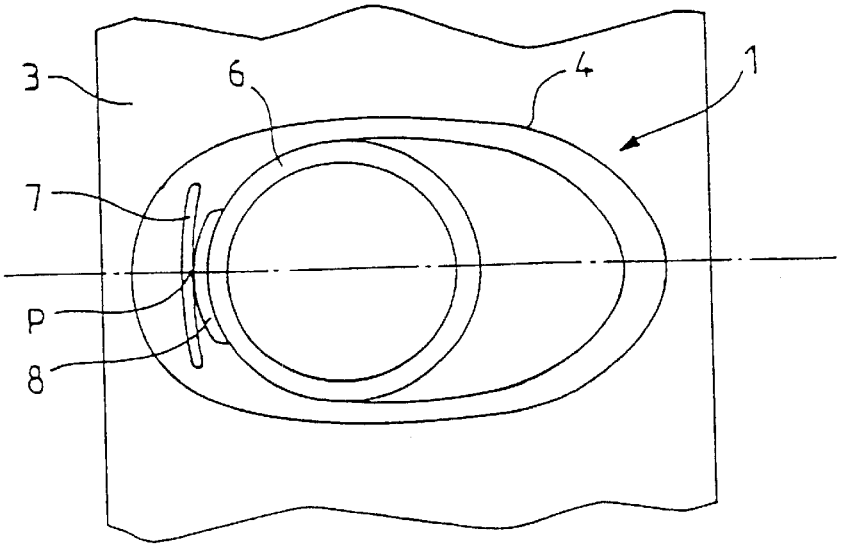
FIG. 3 is a top view of the boot shown in FIG. 2.

The binding device 4 associated to the rear support spoiler 7 is of the type described in U.S. Pat. No. 5,356,170, and consequently, will be described only summarily here. That patent, however, is hereby incorporated by reference thereto in its entirety. The binding device includes a base having a pair of laterally spaced side walls 9 between which the boot 1 is positioned. The rear support spoiler 7 is connected to the rear portion of each of the side walls, as shown in FIG. 2. The shape of the support spoiler 7, in a horizontal sectional plane, is slightly contoured, without being too encompassing in order to allow free lateral bending for the boot.

According to the invention, upper 6 includes an arrangement that distributes the pressure exerted on the lower part of the leg of the user when the upper 6 takes rear support on spoiler 7.

This arrangement is constituted of a relatively rigid plate 8 that is attached to a flexible rear zone of upper 6.

The rigid distribution plate 8 is isolated from all other rigid parts of the boot, as for example, the stiffener 5. More specifically, as shown in FIGS. 1 and 2 the rigid distribution plate is positioned at a height above the ankle area of the upper.

This is essential for the invention in order to retain the flexibility of the upper, which can thus exercise its freedom to move in all directions, and especially in a lateral flexibility.

As mentioned above, the boot will also retain all its flexibility characteristics that are necessary for easy and comfortable walking.

When the flexible upper 6 takes support on the rear spoiler 7 at a point P, which symbolizes a vertical contact generatrix, during a rear edge setting for example, this pressure, instead of being transmitted along the generatrix, is in fact distributed along the distribution plate 8.

It should also be noted that plate 8 is shaped in such a way that it more or less espouses the shape of the calf, and this leads to substantial pressure distribution and improvement in comfort. As shown in the figures, the pressure distribution plate 8 is forwardly concave.

As a general rule, the more encompassing the shape of the plate with respect to the shape of the calf, the greater the pressure that is capable of being borne by the user.

Consequently, the distribution plate 8 will be more contoured, i.e., it will have a greater curvature, than the rear support spoiler in a horizontal sectional plane.

According to another characteristic of the invention, the distribution plate 8 is located in a relatively central zone of the rear portion of upper 6.

Also, according to another characteristic of the invention, the rigid plate 8 extends along a surface so as to enable adequate distribution of pressure, while simultaneously retaining enough of a flexible surface for upper 6 so that such upper can retain a maximum relative flexibility.

According to the embodiment represented in the drawings, the pressure distribution plate 8 is fixedly attached on upper 6.

Specifically, the pressure distribution plate 8 is sewn on upper 6 by a stitching 10.

The distribution plate 8 can be attached via an adhesive on upper 6 rather than being sewn.

The invention also envisions the attachment of the pressure distribution plate 8 on upper 6 in a removable manner.

In this case, the pressure distribution plate 8 is attached to upper 6 via clipping means (not represented) that are arranged in a complementary manner, on the one hand on the inner surface of the plate 8, and on the other hand, on the rear outer surface of upper 6.

Similarly, regarding the principle of a detachable distribution plate 8, such plate can be attached into a corresponding pocket (not represented) obtained on the rear outer surface of upper 6.

The distribution plate 8 can be made of plastic materials that have a low friction coefficient so as to limit the friction between the boot and the rear support spoiler 7 and so as to decrease the wear and tear of this area of the boot, and in particular, of that part of the upper that is in contact with plate 8.

Although the invention has been described with reference to particular means, materials, and embodiments, it is to be understood that the invention is not limited to the particulars expressly disclosed, but the invention extends to all equivalents within the scope of the claims that follow.

What is claimed is:

1. An assembly of a sports boot adapted to be associated to a glide board for snowboarding, and a binding device for securing the sports boot on the glide board, the assembly comprising:

a binding device including a base, the base comprising a pair of laterally spaced side walls, and a relatively rigid rear support spoiler connected to a rear portion of the base; and a sports boot having a relatively flexible upper capable of cooperating with the rear support spoiler, the upper extending along a longitudinal vertical plane, the upper comprising an arrangement that distributes the pressure exerted on the lower part of the leg of the user when the upper takes support on the spoiler, such arrangement comprising a relatively rigid pressure distribution plate attached in a more flexible rearmost zone of the upper and covering at least a rearmost point of the flexible zone of the upper, the rearmost point being positioned within the longitudinal vertical plane, the pressure distribution plate being positioned substantially entirely above an ankle area of the upper and being isolated from all rigid parts of the boot, so as to retain the flexibility of the upper.

2. An assembly according to claim 1, wherein the pressure distribution plate is located in a relatively central zone of the rear portion of the upper of the boot.

3. An assembly according to claim 2, wherein the pressure distribution plate is fixedly attached to the upper of the boot.

4. An assembly according to claim 2, wherein the pressure distribution plate is attached to the upper of the boot in a detachable manner.

5. An assembly according to claim 2, wherein the rigid plate extends along a surface to allow adequate pressure distribution, while simultaneously retaining adequate surface flexibility for the upper of the boot so that the upper retains maximum relative flexibility.

6. An assembly according to claim 1, wherein the rigid plate extends along a surface to allow adequate pressure distribution, while simultaneously retaining adequate surface flexibility for the upper of the boot so that the upper retains maximum relative flexibility.

7. An assembly according to claim 3, wherein the pressure distribution plate is fixedly attached to the upper of the boot.

8. An assembly according to claim 5, wherein the pressure distribution plate is attached to the upper of the boot in a detachable manner.

9. An assembly according to claim 1, wherein the pressure distribution plate is fixedly attached to the upper of the boot.

10. An assembly according to claim 9, wherein the pressure distribution plate is sewn onto the upper of the boot.

11. An assembly according to claim 9, wherein the pressure distribution plate is attached to the upper of the boot by adhesive.

12. An assembly according to claim 1, wherein the pressure distribution plate is attached to the upper of the boot in a detachable manner.

13. An assembly according to claim 12, wherein the pressure distribution plate is attached to the upper of the boot with a clipping means arranged in a complementary manner on an inner surface of the plate and on an outer surface of the upper.

14. An assembly according to claim 12, wherein a rear outer surface of the upper of the boot includes a pocket and the pressure distribution plate is attached to the upper of the boot by being positioned in the pocket.

15. An assembly according to claim 1, wherein the pressure distribution plate has a forwardly facing concave curvature.

16. An assembly according to claim 1, wherein the pressure distribution plate has a forwardly facing concave curvature, the curvature being greater than a curvature of the rear support spoiler in a horizontal sectional plane.

17. An assembly according to claim 1, wherein the rear support spoiler is connected to a rear portion of the side walls of the base.

18. An assembly according to claim 1, wherein the flexible upper of the boot includes lateral portions that are made of flexible material to confer a lateral flexibility during use of the boot.

19. A sports boot adapted for snowboarding, said sports boot comprising:

a relatively flexible upper for receiving a lower part of a leg of a user of the boot, said upper capable of cooperating with an upper rear support member of a binding system for supporting at least a rear portion of said upper, said upper extending along a longitudinal vertical plane;

a relatively rigid pressure distribution element extending to, secured to, and covering at least a rearmost point of said relatively flexible upper, said rearmost point being positioned within said longitudinal vertical plane, said pressure distribution element being positioned substantially entirely above an upper half of the boot and being isolated from all other rigid parts of the boot to retain flexibility of said rear portion of said relatively flexible upper, said pressure distribution element distributing pressure exerted on the lower part of the leg of the user by said upper rear support member of the binding system.

20. A sports boot according to claim 19, wherein said pressure distribution plate is located in a relatively central zone of said upper rear portion of said upper of the boot.

21. A sports boot according to claim 19, wherein said pressure distribution plate is sewn onto said upper of the boot.

22. A sports boot according to claim 19, wherein said pressure distribution plate is attached to said upper of the boot by adhesive.

23. A sports boot according to claim 19, wherein said pressure distribution plate is attached to said upper of the boot in a detachable manner.

24. A sports boot according to claim 19, wherein said rear portion of said upper includes an outer surface with a pocket mounted to said outer surface, said pressure distribution plate being attached to the upper of the boot by being positioned in said pocket.

25. A sports boot according to claim 19, wherein said pressure distribution plate has a forwardly facing concave curvature.

26. A sports boot according to claim 19, wherein said flexible upper of the boot includes lateral portions that are made of flexible material to confer a lateral flexibility during use of the boot.

27. A snowboard boot comprising:

an upper extending along a longitudinal vertical plane, said upper having a lower portion, an ankle portion, and a portion above said ankle portion, said upper having a size and shape adapted to receive a lower part of a leg of a user of the boot, said upper capable of cooperating with an upper rear support member of a binding system for supporting at least a rearmost portion of said upper, said upper being relatively flexible for facilitating walking and for facilitating lateral movement of said upper during snowboarding;

a pressure distribution element attached to and covering at least a point of said rearmost portion of said relatively flexible upper of said longitudinal vertical plane, said pressure distribution element being made of a material relatively more rigid than said relatively flexible upper, said pressure distribution element being substantially entirely positioned in said portion of said upper above said ankle portion and being isolated from other rigid parts of the boot to enable said upper to retain said lateral movement facility during snowboarding, said pressure distribution element being adapted to distribute pressure exerted on the lower part of the leg of the user by the upper rear support member of the binding system.

28. A snowboard boot according to claim 27, wherein:

said pressure distribution element having a forward facing concave curvature.

29. A snowboard boot according to claim 27, wherein:

said pressure distribution element is releasably affixed to said upper.

* * * * *